United States Patent [19]

Grell

[11] Patent Number: 4,888,065

[45] Date of Patent: Dec. 19, 1989

[54] METHOD OF MAKING ROLLER BEARING ELEMENT AND PRODUCT THEREFROM

[75] Inventor: Karl-Ludwig Grell, Aurachtal, Fed. Rep. of Germany

[73] Assignee: INA Walzlager Schaeffler KG, Fed. Rep. of Germany

[21] Appl. No.: 906,365

[22] Filed: Sep. 11, 1986

[30] Foreign Application Priority Data

Oct. 23, 1985 [DE] Fed. Rep. of Germany ..... 3537658

[51] Int. Cl.[4] ..... C21D 1/74

[52] U.S. Cl. ..... 148/16.5; 148/16.6; 148/318; 148/319

[58] Field of Search ..... 148/902, 906, 16.5, 148/16.6, 402, 317–319, 136; 384/625, 912

[56] References Cited

U.S. PATENT DOCUMENTS

| | | | |
|---|---|---|---|
| 2,228,106 | 1/1941 | Berra | 148/318 |
| 2,300,274 | 10/1942 | Dahl et al. | 148/136 |
| 2,561,945 | 7/1951 | Payson | 148/136 |
| 2,851,387 | 9/1958 | Low | 148/136 |
| 3,929,523 | 12/1975 | Kinoshi et al. | 148/143 |
| 4,154,629 | 5/1979 | Asai et al. | 148/16.5 |
| 4,382,829 | 5/1983 | Kaners et al. | 148/39 |

FOREIGN PATENT DOCUMENTS

| | | | |
|---|---|---|---|
| 2445684 | 4/1976 | Fed. Rep. of Germany | 148/16.5 |
| 41024 | 11/1974 | Japan | 148/16.5 |
| 58421 | 5/1978 | Japan | 148/319 |

OTHER PUBLICATIONS

Metals Handbook vol. 4, Heat Treating, pp. 135–136, ©1981.

*Primary Examiner*—Christopher W. Brody
*Attorney, Agent, or Firm*—Bierman and Muserlian

[57] ABSTRACT

A method of producing a hardened non-magnetizable roller bearing element made of an austenitic material comprising carburizing the near-surface material layer of a roller bearing element in an oxygen-free atmosphere at high temperatures and then cooling the roller bearing element and the element produced by the process having a load bearing capacity equal to steel roller bearing elements but still non-magnetizable.

9 Claims, No Drawings

METHOD OF MAKING ROLLER BEARING ELEMENT AND PRODUCT THEREFROM

STATE OF THE ART

Hardened non-magnetizable roller bearing elements made of austenitic material are known and such elements are used e.g. in electromechanical devices in areas where the magnetic flux should be interrupted and where they are required because of their high corrosion resistance. A method of producing such roller bearing elements is already known in which an increase of the hardness of the roller bearing element is provided through work-hardening but the known method is useful only to a limited degree since work-hardening leads to a hardness exceeding 450 HV which results in the formation of transformed martensite within the structure of the roller bearing element thereby magnetizing the latter and rendering it unsuitable for applications in which non-magnetizable roller bearing elements of increased load-bearing capacity are required. Because only slight hardness is obtainable, non-magnetizable roller bearing elements made by the known method have only about 25% of the load-bearing capacity of comparable conventional roller bearing elements.

Although it has been tried to produce non-magnetizable roller bearing elements of increased load-bearing capacity through heat treatment methods, the resulting roller bearing elements were constantly magnetizable and/or did not have the required hardness. This led in practice to attempts which obtain quasi non-magnetizable roller bearing elements of sufficient load-bearing capacity by applying e.g. comparably thin-walled webs of hardened ferromagnetic materials onto massive elements of austenitic materials. These solutions are usually only of makeshift nature and are technically unsatisfactory. Further, they incur considerable expenses.

OBJECTS OF THE INVENTION

It is an object of the invention to provide a novel method to produce roller bearing elements from austenitic material which have a load-bearing capacity comparable to steel roller bearing elements while still retaining their non-magnetization ability.

THE INVENTION

The novel method of the invention of producing a hardened non-magnetizable roller bearing element made of an austenitic material comprises carburizing the near-surface material layer of a roller bearing element in an oxygen-free atmosphere at high temperatures and then cooling the roller bearing element. The oxygen-free atmosphere may contain arbitrary carburizing gaseous substances.

The method of the invention leads within the surface area of the roller bearing element to a structure comprising a high-cementite phase which is metallographically and crystallographically comparable with ledeburite and substantially non-magnetizable and has a hardness of up to 700 HV. The core area of the element consists of the austenitic initial material. Provided that the roller bearing element is treated by the invention over a sufficiently long period of time which is dependent on the respective element and case of application, the hardened surface area of the roller bearing element has a thickness which despite the relatively soft austenitic core area of the roller bearing element meets the load requirements usually demanded of roller bearing elements.

It has been determined that the roller bearing elements produced by the invention surprisingly maintain their strength and hardness up to temperatures of 600° C. so that they are suitable not only for applications in which a non-magnetizable roller bearing is required but also for those applications requiring a high temperature resistance of the roller bearing. Moreover, roller bearings made of roller bearing elements produced by the method of the invention are suitable for those applications in which roller bearings cooperate with adjoining elements made of aluminum alloys since the coefficient of thermal expansion of austenitic materials corresponds to that of aluminum alloys. Problems of fit encountered in conventional roller bearings in view of the different coefficients of thermal expansion are avoided through the use of roller bearing elements produced by the method of the invention.

In a modification of the invention, especially positive results are achieved when carburizing the roller bearing element in a oxygen-free atmosphere containing methane or propane or a mixture thereof. According to another embodiment of the invention, roller bearing elements having a hardness of more than 700 HV can be produced in an oxygen-free atmosphere containing atomic nitrogen. Nitrogen diffuses into the surface-near material layer of the roller bearing element and forms nitrides which cause a further increase of hardness of the surface-near structure.

An especially uniform structure of the surface-near material layer of the roller bearing element is achieved in an embodiment of the invention in which the roller bearing element is carburized at temperatures between 800° and 1000° C., preferably, between 880° and 960° C.

The roller bearing elements produced by the method of the invention meet the posed requirements to an especially high degree when according to an embodiment of the invention, the carbon content within the surface-near material layer is at least 1.5% and according to a further embodiment of the invention, the roller bearing element has a surface hardness of at least 550 HV.

In a modification of the invention, the roller bearing element made by the method of the invention comprises one of the austenitic materials X 5 CrNi 18 9, x 12 CrNiS 18 8, X 12 CrNi 17 7 or X 10 CrNiTi 18 9 which have proven especially suitable for the method of the invention.

By means of the said method, it is possible to produce a roller bearing element made of an austenitic material which within the surface-near material layer has a hardness sufficient for typical roller bearing loads and yet is non-magnetizable. Furthermore, roller bearing elements produced by the method of the invention have a high temperature strength and moreover an increased corrosion resistance in comparison to conventional roller bearing elements. Finally, the roller bearing elements produced by the method of the invention can cooperate with elements made of aluminum alloys without any problems of fit as both have approximately corresponding coefficients of thermal expansion.

Various modifications of the roller bearing elements and the method may be made without departing from the spirit or scope thereof and it is to be understood that the invention is intended to be limited only as defined in the appended claims.

What I claim is:

1. A method of producing a hardened rolling bearing element by carburizing the near-surface material at high temperatures and subsequent cooling, characterized in that the rolling bearing element is made from a non-magnetizable austenitic material and then carburized in an oxygen-free atmosphere.

2. The method of claim 1 wherein the oxygen-free atmosphere contains at least one member of the group consisting of methane and propane.

3. The method of claim 2 wherein the atmosphere also contains atomic nitrogen.

4. The method of claim 1 wherein the oxygen-free atmosphere contains atomic nitrogen.

5. The method of claim 1 wherein the high temperature is 800° to 1000° C.

6. The method of claim 1 wherein the high temperature is 880° to 960° C.

7. A roller bearing element produced by the method of claim 1 and having a carbon content in its near-surface layer of material of at least 1.5% .

8. The elements of claim 7 having a surface hardness of at least 550 HV.

9. The element of claim 7 wherein the austenitic material is selected from the group consisting of X 5 CrNi 18 9, X 12 Cr NiS 18 8, X 12 CrNi 17 7 and X 10 CrNiTi 18 19.

* * * * *